US006084142A

United States Patent [19]

Yao et al.

[11] Patent Number: 6,084,142

[45] Date of Patent: Jul. 4, 2000

[54] METHOD OF MAKING AN IMPROVED ZEOLITE CATALYST, A PRODUCT FROM SUCH METHOD, AND THE USE THEREOF IN THE CONVERSION OF HYDROCARBONS

[75] Inventors: Jianhua Yao, Bartlesville; Charles A. Drake, Nowata, both of Okla.

[73] Assignee: Phillips Petroleum Company, Bartlesville, Okla.

[21] Appl. No.: 09/076,690

[22] Filed: May 12, 1998

[51] Int. Cl.[7] ..... C07C 15/00

[52] U.S. Cl. ..... 585/407; 502/77; 585/415; 585/475; 585/486; 585/653; 208/110; 208/133

[58] Field of Search ..... 502/64, 71, 77; 585/415, 407, 475, 486, 653; 208/110, 133

[56] References Cited

U.S. PATENT DOCUMENTS

| | | | |
|---|---|---|---|
| 4,663,025 | 5/1987 | Fu | 208/120 |
| 4,720,602 | 1/1988 | Chu | 585/407 |
| 4,804,801 | 2/1989 | Yan | 585/407 |
| 5,776,852 | 7/1998 | Wu et al. | 502/177 |
| 5,804,059 | 9/1998 | Wu et al. | 208/135 |
| 5,827,422 | 10/1998 | Drake et al. | 208/135 |
| 5,866,741 | 2/1999 | Wu et al. | 585/475 |
| 5,866,742 | 2/1999 | Wu et al. | 585/475 |
| 5,866,744 | 2/1999 | Wu et al. | 585/486 |
| 5,883,033 | 3/1999 | Drake et al. | 502/68 |
| 5,883,034 | 3/1999 | Drake et al. | 502/68 |

FOREIGN PATENT DOCUMENTS

| | | | |
|---|---|---|---|
| 7-29948 | 4/1995 | Japan | C07C 15/02 |

*Primary Examiner*—Tom Dunn
*Assistant Examiner*—Cam N. Nguyen
*Attorney, Agent, or Firm*—Reece A. Scott

[57] ABSTRACT

An improved zeolite catalyst containing a zeolite and a zinc component manufactured by a novel method having certain process steps necessary for providing the improved zeolite catalyst. The process steps include incorporation of a zinc component with such zeolite followed by a steam treatment. An acid treatment can be conducted after the steam treatment. Processes are also disclosed for using the improved zeolite catalyst in the conversion of hydrocarbons, preferably non-aromatic hydrocarbons, to lower olefins (such as ethylene, propylene, and butene) and aromatic hydrocarbons (such as benzene, toluene, and xylene).

27 Claims, 2 Drawing Sheets

METHOD OF MAKING AN IMPROVED ZEOLITE CATALYST, A PRODUCT FROM SUCH METHOD, AND THE USE THEREOF IN THE CONVERSION OF HYDROCARBONS

BACKGROUND OF THE INVENTION

The invention relates to an improved method of making a zeolite catalyst composition having improved properties when compared with certain other zeolite catalysts.

It is known to catalytically crack gasoline boiling range hydrocarbons (in particular, non-aromatic gasoline boiling range hydrocarbons, more in particular, paraffins and olefins) to lower olefins, also referred to as light olefins (such as ethylene and propylene and also butenes such as 1-butene, 2-butene, and also isobutylene), and aromatic hydrocarbons (such as BTX, i.e., benzene, toluene, and xylenes, and also ethylbenzene) in the presence of catalysts which contain a zeolite (such as ZSM-5), as is described in an article by N. Y. Chen et al. in Industrial & Engineering Chemistry Process Design and Development, Volume 25, 1986, pages 151–155. The reaction product of this catalytic cracking process contains a multitude of hydrocarbons such as unconverted $C_5$+ alkanes, lower alkanes (methane, ethane, propane), lower alkenes (ethylene and propylene), $C_6$–$C_8$ aromatic hydrocarbons (benzene, toluene, xylene, and ethylbenzene), and $C_9$+ aromatic hydrocarbons. Depending upon the relative market prices of the individual reaction products, it can be desirable to increase the yield of certain of the more valuable products relative to the others.

One concern with the use of zeolite catalysts in the conversion of hydrocarbons to aromatic hydrocarbons and lower olefins is the excessive production of coke during the conversion reaction. The term "coke" refers to a semi-pure carbon generally deposited on the surface of a metal wall or a catalyst. Coke formed during the zeolite catalyzed aromatization of hydrocarbons tends to cause catalyst deactivation. It is desirable to improve processes for the aromatization of hydrocarbons, and the formation of lower olefins from hydrocarbons, by minimizing the amount of coke formed during such processes. It is also desirable to have a zeolite catalyst that is useful in producing significant quantities of the aromatic and olefin conversion products.

SUMMARY OF THE INVENTION

It is an object of this invention to at least partially convert hydrocarbons to aromatics (such as BTX, i.e., benzene, toluene, xylene and also ethylbenzene) and lower olefins, also referred to as light olefins (such as ethylene and propylene and also butenes such as 1-butene, 2-butene, and also isobutylene), utilizing an improved zeolite catalyst, that has been prepared by a method omitting the pre-treatment of such zeolite with steam or acid before such zeolite is combined with a zinc component.

Another object of this invention is to provide a method for making an improved zeolite catalyst that does not require (i.e., omits) a steam pre-treating or acid pre-treating of the zeolite or zeolite material before such zeolite is combined with a zinc component. The improved zeolite catalyst has such desirable properties as providing for lower coke production and an improved yield of lower olefins (such as ethylene, propylene, and butene) when utilized in the conversion of hydrocarbons.

A further object of this invention is to provide an improved process for the conversion of hydrocarbons in which the rate of coke formation during such conversion of hydrocarbons is minimized.

A yet further object of this invention is to provide an improved zeolite material which, when used in the conversion of hydrocarbons, results in less coke formation than alternative zeolite materials.

Another object of this invention is to provide an improved zeolite material that gives an improved yield of lower olefins when utilized in the conversion of hydrocarbons.

Yet another object of this invention is to provide hydrocarbon conversion processes which have an acceptably low coke production rate and/or which produce a conversion product containing suitable quantities of aromatics (such as BTX) and lower olefins (such as ethylene, propylene, and butene).

Yet another further object of this invention is to provide a method for making an improved zeolite material having such desirable properties as providing for low coke production and improved yields of lower olefins, with an especially improved ratio of olefins to aromatics in the product, when used in the conversion of hydrocarbons.

One of the inventive methods provides for the conversion of hydrocarbons, preferably non-aromatic hydrocarbons, to aromatic hydrocarbons (such as BTX) and lower olefins (such as ethylene, propylene, and butene) by contacting, under reaction conditions (i.e., conversion conditions), a hydrocarbon-containing fluid with an improved zeolite catalyst composition. The improved zeolite catalyst composition is prepared by a method that includes utilizing a zeolite that has not been pre-treated with steam or acid before such zeolite is combined, or incorporated, with a zinc component, and, optionally, a binder, to form a mixture. The mixture is then treated (i.e., post-treated) with steam, and, preferably, the steam-treated mixture is then treated (i.e., post-treated) with acid, to form the improved zeolite catalyst composition. Thus, an embodiment of the invention is a novel composition comprising a mixture that has been treated with steam wherein the mixture comprises a zeolite (that has not been pre-treated with steam or acid), a zinc component, and, optionally, a binder.

Another embodiment of the invention is a novel composition comprising a mixture that has been treated (i.e., post-treated) with steam and then treated (i.e., post-treated) with an acidic solution wherein the mixture comprises a zeolite (that has not been pre-treated with steam or acid), a zinc component, and, optionally, a binder. The zeolite catalyst composition prepared by the novel inventive method can be used to convert hydrocarbons, preferably non-aromatic hydrocarbons, to preferably, aromatics and lower olefins, by contacting the catalyst under reaction conditions with a hydrocarbon-containing fluid.

Other objects and advantages of the invention will become apparent from the detailed description and the appended claims.

DETAILED DESCRIPTION OF THE INVENTION

Figure 1:
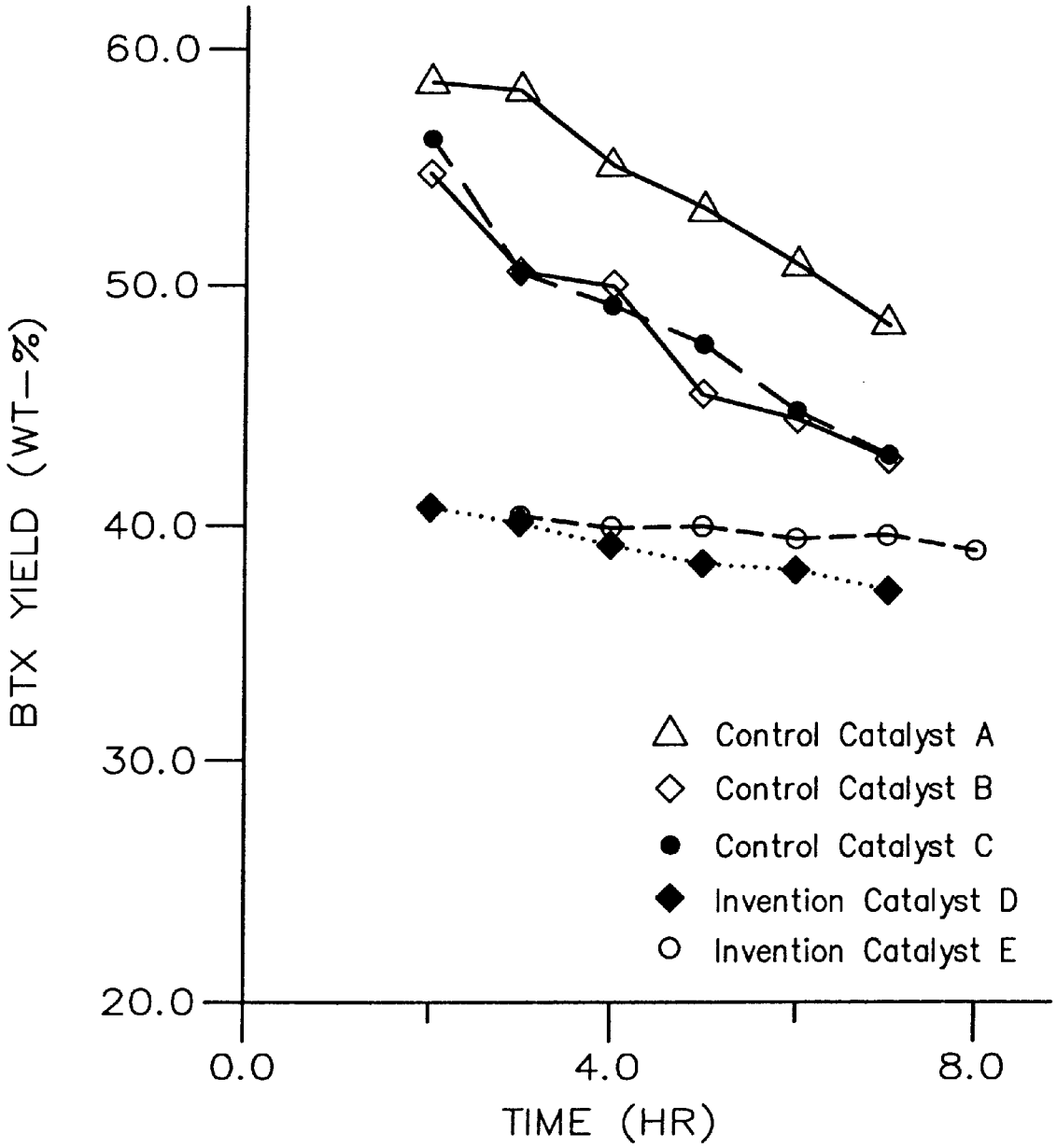
FIG. 1 is a plot of the BTX yield versus time for the inventive catalysts and the control catalysts illustrating that the stability (in terms of BTX wt-% yield over time) of the inventive catalysts is greater than the control catalysts.

It has been discovered that the performance of a catalyst containing a zeolite and a zinc component can be improved by utilizing a novel process of making such catalyst. This novel process of making the improved zeolite catalyst containing a zeolite and a zinc component uses specific manufacturing steps and sequence of steps to give the improved zeolite catalyst.

The inventive composition includes utilizing a zeolite or zeolite material that has not been pre-treated with steam or acid. The zeolite is combined, or incorporated, with a zinc component and, optionally, a binder and/or binder material to form a mixture, or combination, wherein such mixture is treated with steam, or steam and acid, subsequent to such incorporation of a zinc component into, onto, or with the zeolite. The resulting mixture can be used to provide an improved yield of lower olefins and an improved olefins-to-aromatics ratio when used in the conversion of hydrocarbons, preferably non-aromatic hydrocarbons, than a catalyst that is made by certain methods other than the inventive method described herein. The term "fluid" is used herein to denote gas, liquid, vapor, or combinations thereof.

An important feature of this invention is that the zeolite component of the composition is not pre-treated with steam or acid prior to incorporating a zinc component into, onto, or with such zeolite component.

The zeolite starting material used in the composition of the invention can be any zeolite or zeolite material which is effective in the conversion of hydrocarbons to aromatic hydrocarbons and lower olefin hydrocarbons when contacted under suitable reaction conditions. Examples of suitable zeolites include, but are not limited to, those disclosed in Kirk-Othmer Encyclopedia of Chemical Technology, third edition, volume 15, pages 638–669 (John Wiley & Sons, New York, 1981). Preferably, the zeolite has a constraint index (as defined in U.S. Pat. No. 4,097,367, which is incorporated herein by reference) in the range of from about 0.4 to about 12, preferably in the range of from about 2 to about 9. Generally, the molar ratio of $SiO_2$ to $Al_2O_3$ in the crystalline framework of the zeolite is at least about 5:1 and can range up to infinity. Preferably the molar ratio of $SiO_2$ to $Al_2O_3$ in the zeolite framework is in the range of from about 8:1 to about 200:1, more preferably in the range of from about 12:1 to about 100:1. Preferred zeolites include ZSM-5, ZSM-8, ZSM-11, ZSM-12, ZSM-35, ZSM-38, and combinations thereof. Some of these zeolites are also known as "MFI" or "Pentasil" zeolites. The presently more preferred zeolite is ZSM-5.

An important aspect of this invention is the incorporation of a zinc component into, onto, or with the zeolite or zeolite material to produce a zeolite catalyst composition without the need to pre-treat the zeolite with steam or acid. It has been discovered that there are certain benefits from subsequently (i.e., post) steam treating a zeolite catalyst having incorporated therein, thereon, or therewith a zinc component without pre-treating the zeolite with steam or acid prior to such incorporation of such zinc component. Depending on the use of the zeolite catalyst, such unexpected benefits include lower coke production and an improved (i.e., greater) olefins-to-aromatics ratio. These benefits result from utilizing the improved zeolite catalyst composition.

Incorporated into, onto, or with the zeolite is a zinc component, or zinc components, to form an incorporated zeolite. The zinc component may be incorporated into, onto, or with the zeolite by any suitable means or method(s) known in the art for incorporating elements into, onto, or with a substrate material to form an incorporated zeolite catalyst. A preferred method is the use of any standard incipient wetness impregnation technique (i.e., essentially completely filling the pores of the substrate material with a solution of the incorporating elements) for impregnating a zeolite substrate with a zinc component. The preferred method uses an impregnating solution containing the desirable concentrations of a zinc component so as to ultimately provide an impregnated zeolite having the required concentration of zinc which can then be subjected to a steam treatment, or a steam treatment followed by treatment with an acidic solution, to produce the final zeolite catalyst composition.

It is particularly desirable to use, for the impregnation of the zeolite, an aqueous solution of a zinc component, or aqueous solutions of zinc components, that are incorporated into, onto, or with the zeolite. The zinc component or zinc components may be impregnated into, onto, or with the zeolite simultaneously, or sequentially, or both, provided the zeolite ultimately contains zinc.

The preferred impregnating solution may be an aqueous solution formed by dissolving a salt, such as including, but not limited to, a nitrate, a phosphate, a sulfate, or combinations thereof, of zinc in a solvent, preferably water. The preferred impregnating solution is an aqueous solution formed by dissolving a salt of zinc (preferably, zinc nitrate) in water. It is acceptable to use somewhat of an acidic solution to aid in the dissolution of the salt of zinc.

Examples of a potentially suitable zinc component for incorporating, preferably impregnating, zinc into, onto, or with the zeolite include, but are not limited to, zinc nitrate, hydrated zinc nitrate, diethylzinc, dimethylzinc, diphenylzinc, zinc acetate dehydrate, zinc acetylacetonate hydrate, zinc bromide, zinc carbonate hydroxide, zinc chloride, zinc cyclohexanebutyrate dihydrate, zinc 2-ethylhexanoate, zinc fluoride, zinc fluoride tetrahydrate, zinc hexafluoroacetylacetonate dihydrate, zinc iodide, zinc molybdate, zinc naphthenate, zinc nitrate hexahydrate, zinc oxide, zinc perchlorate hexahydrate, zinc phosphate hydrate, zinc phthalocynine, zinc protoporphyrin, zinc selenide, zinc sulfate monohydrate, zinc sulfide, zinc telluride, zinc tetrafluoroborate hydrate, zinc meso-tetraphenylprophine, zinc titanate, zinc trifluoromethanesulfonate, and combinations thereof. The preferred zinc component for incorporating, preferably impregnating, zinc into, onto, or with the zeolite is zinc nitrate, preferably hydrated zinc nitrate, and more preferably zinc nitrate hexahydrate.

The amounts of zinc component incorporated, preferably impregnated, into, onto, or with the zeolite should be such as to give concentrations of zinc effective in providing the desirable properties of favorable (i.e., greater) olefin conversion yields, favorable (i.e., greater) olefins-to-aromatics ratio, and low coke production when the improved zeolite catalyst, as manufactured by the method described herein, is employed in the conversion of hydrocarbons, preferably non-aromatic hydrocarbons.

Generally, the amount of zinc component incorporated, preferably impregnated, into, onto, or with the zeolite is such that the weight percent of zinc present in the final improved zeolite catalyst composition is generally in the range upwardly to about 10 weight percent of the total weight of the final improved zeolite catalyst. The preferred concentration of zinc present in the final improved zeolite catalyst is in the range of from about 0.05 weight percent of the total weight of the final improved zeolite catalyst to about 8 weight percent of the total weight of the final improved zeolite catalyst and, most preferably, in the range from 0.1 weight percent of the total weight of the final improved zeolite catalyst to 6 weight percent of the total weight of the final improved zeolite catalyst.

The incorporated, preferably impregnated, zeolite catalyst can then be dried at a temperature in the range of from about 50° C. to about 800° C. preferably in the range of from about 75° C. to about 700° C., and most preferably in the range from 100° C. to 650° C. and a pressure in the range of from about 7 pounds per square inch absolute (psia) to about 500 psia, preferably in the range of from about 7 psia to about 300 psia, more preferably in the range of from about 7 psia to about 150 psia, and most preferably about 14.7 psia (atmospheric) for a time period in the range of from about 0.25 hour to about 15 hours, preferably in the range of from about 0.5 hour to about 12 hours, and most preferably in the range from 1 hour to 10 hours, to produce a dried, incorporated zeolite catalyst composition. Any drying method(s) known to one skilled in the art such as, for example, air drying, heat drying, spray drying, fluidized bed drying, or combinations thereof can be used.

The resulting dried, incorporated zeolite composition can be calcined, if desired, under a condition known to those skilled in the art. Generally such a condition can include a temperature in the range of from about 250° C. to about 1,000° C., preferably in the range of from about 350° C. to about 750° C., and most preferably in the range from 400° C. to 650° C. and a pressure in the range of from about 7 pounds per square inch absolute (psia) to about 750 psia, preferably in the range of from about 7 psia to about 450 psia, and most preferably in the range from 7 psia to 150 psia for a time period in the range of from about 1 hour to about 30 hours, preferably in the range of from about 2 hours to about 20 hours, and most preferably in the range from 3 hours to 15 hours.

The incorporated, preferably impregnated, zeolite catalyst, or the incorporated, preferably impregnated, dried zeolite catalyst, or the incorporated, preferably impregnated, dried and calcined zeolite catalyst is then subjected to a steam treatment whereby it is exposed, by any suitable method(s) known in the art, to an atmosphere of steam under process conditions that suitably provide an improved zeolite catalyst for use in converting hydrocarbons, preferably for use in converting non-aromatic hydrocarbons. The steam treatment of the incorporated, preferably impregnated, zeolite, i.e., subsequent to incorporation of a zinc component into, onto, or with the zeolite, is important, as earlier indicated, to the manufacture of the improved zeolite catalyst composition.

During the steam treatment, the incorporated, preferably impregnated, zeolite is exposed to a predominantly gaseous atmosphere, preferably an entirely gaseous atmosphere, comprising steam. Preferably, the steam atmosphere has a steam concentration exceeding about 90 molar percent steam and, most preferably, the steam atmosphere has a steam concentration exceeding about 95 molar percent steam. Generally, the steam treatment may be conducted at a pressure in the range of from below atmospheric upwardly to about 1000 pounds per square inch absolute (psia). More typical pressures, however, are in the range of from about atmospheric to about 100 psia. The steam treatment temperature is generally in the range of from about 100° C. to about 1000° C. Preferably, this temperature is in the range of from about 101° C. to about 800° C. and, most preferably, the steam treatment temperature is in the range from 102° C. to 600° C.

The time period for conducting the steam treatment must be sufficient to provide a suitably treated catalyst having the desired properties. Generally, the time period of the steam treatment for exposing the incorporated zeolite, preferably impregnated zeolite, to an atmosphere of steam at appropriate temperature conditions, can be in the range of from about 0.1 hour to about 30 hours. Preferably, the steam treatment is conducted for a time period in the range of from about 0.25 hour to about 25 hours and, most preferably, in the range from 0.5 hour to 20 hours.

The incorporated, steam-treated zeolite catalyst composition, preferably impregnated, steam-treated zeolite catalyst composition, can then be subjected to an acid treatment whereby it is exposed, by any suitable method(s) known in the art, to an acid under conditions that suitably provide an improved zeolite catalyst composition for use in converting hydrocarbons, preferably for use in converting non-aromatic hydrocarbons.

The incorporated, steam-treated zeolite catalyst composition, preferably impregnated, steam-treated zeolite catalyst composition, can be treated with an acid by any suitable means or method(s) that results in an incorporated, (preferably impregnated) steam-treated, acid-treated zeolite catalyst composition. Generally, any organic acid, inorganic acid, or combinations thereof can be used in the process of the present invention. The acid can be a diluted aqueous acid solution. Examples of possible acids include, but are not limited to, sulfuric acid, hydrochloric acid, nitric acid, phosphoric acid, formic acid, acetic acid, trifluoroacetic acid, trichloroacetic acid, p-toluenesulfonic acid, methanesulfonic acid, partially neutralized acids wherein one or more protons have been replaced with, for example, a metal (preferably an alkali metal), and combinations thereof. Examples of partially neutralized acids include, but are not limited to, sodium bisulfate, sodium dihydrogen phosphate, potassium hydrogen tartarate, ammonium sulfate, ammonium chloride, ammonium nitrate, and combinations thereof. The presently preferred acid is aqueous hydrochloric acid.

Any method(s) known to one skilled in the art for treating a solid catalyst with an acid can be used in the acid treatment of the present invention. Generally, the incorporated (preferably impregnated), steam-treated zeolite catalyst composition can be washed with an acid solution or suspended in an acid solution. The concentration of the incorporated, steam-treated zeolite catalyst composition in the acid solution can be in the range of from about 0.01 gram per liter to about 500 grams per liter, preferably in the range of from about 0.1 gram per liter to about 400 grams per liter, more preferably in the range of from about 1 gram per liter to about 350 grams per liter, and most preferably in the range from 5 grams per liter to 300 grams per liter.

Generally, the concentration of the acid, preferably aqueous hydrochloric acid, can be in the range of from about 0.01 molar (molar refers to a concentration in which 1 molecular weight in grams (1 mole) of a substance is dissolved in enough solvent to make one liter of solution, for example, 1 molar hydrochloric acid refers to 36.46 grams/liter of hydrochloric acid) to about 15 molar, preferably in the range of from about 0.02 molar to about 10 molar, more preferably in the range of from about 0.05 molar to about 8 molar, and most preferably in the range from 0.1 molar to 6 molar.

The mixture of acid and incorporated (preferably impregnated), steam-treated zeolite catalyst composition can be subjected to a temperature in the range of from about 10° C. to about 80° C., preferably in the range of from about 15° C. to about 75° C. and most preferably in the range from 20° C. to 70° C., for a time period in the range of from about 0.1 minute to about 1 hour, preferably in the range of from about 0.5 minute to about 45 minutes, and most preferably in the range from 1 minute to 30 minutes and under a pressure in the range of from about atmospheric to about 150 pounds per square inch absolute (psia), preferably about atmospheric, so long as the desired temperature can be maintained. The acid can then be separated from, preferably decanted from or filtered from, the incorporated, steam-treated, acid-treated zeolite catalyst composition.

The acid treatment of the incorporated, steam-treated zeolite catalyst composition may be accomplished in one separate acid treatment or in a series of acid treatments so long as the acid treatment(s) result in an incorporated (preferably impregnated), steam-treated, acid-treated zeolite catalyst composition having the desired properties such as favorable (i.e., greater) olefin conversion yields, favorable (i.e., greater) olefins-to-aromatics ratio, and low coke production.

Thereafter, the incorporated, steam-treated, acid-treated zeolite catalyst composition can be washed with distilled water for a time period in the range of from about 1 minute to about 60 minutes followed by drying, at a temperature in the range of from about 50° C. to about 800° C., preferably in the range of from about 75° C. to about 700° C., and most preferably in the range from 100° C. to 650° C. for a time period in the range of from about 0.5 hour to about 15 hours, preferably in the range of from about 1 hour to about 12 hours, and most preferably in the range from 1 hour to 10 hours, to produce an incorporated, steam-treated, acid-treated zeolite catalyst composition. Any drying method(s) known to one skilled in the art such as, for example, air drying, heat drying, spray drying, fluidized bed drying, or combinations thereof can be used.

The resulting dried, acid-treated zeolite composition can be calcined, if desired, under a condition known to those skilled in the art. Generally such a condition can include a temperature in the range of from about 250° C. to about 1,000° C., preferably in the range of from about 350° C. to about 750° C., and most preferably in the range from 400° C. to 650° C. and a pressure in the range of from about 7 pounds per square inch absolute (psia) to about 750 psia, preferably in the range of from about 7 psia to about 450 psia, and most preferably in the range from 7 psia to 150 psia for a time period in the range of from about 1 hour to about 30 hours, preferably in the range of from about 1.5 hours to about 20 hours, and most preferably in the range from 2 hours to 15 hours.

The improved zeolite catalyst composition described herein can also contain an inorganic binder (also called matrix material) preferably selected from the group consisting of alumina, silica, alumina-silica, aluminum phosphate, clays (such as bentonite), and combinations thereof. The content of the zeolite component (e.g., incorporated zeolite, incorporated, steam-treated zeolite, or incorporated, steam-treated, acid-treated zeolite) of the optional mixture, of zeolite component and inorganic binder, is in the range of from about 1 weight percent of the total weight of the optional mixture to about 99 weight percent of the total weight of the optional mixture. Preferably, the content of the zeolite component of the optional mixture is in the range of from about 5 weight percent of the total weight of the optional mixture to about 80 weight percent of the total weight of the optional mixture.

Any suitable means for mixing the zeolite component and binder can be used to achieve the desired dispersion of the materials in the resulting admixture. Many of the possible mixing means suitable for use in preparing the mixture of zeolite component and binder of the inventive method are described in detail in *Perry's Chemical Engineers' Handbook, Sixth Edition,* published by McGraw-Hill, Inc., copyright 1984, at pages 21–3 through 21–10, which pages are incorporated herein by reference. Thus, suitable mixing means can include, but are not limited to, such devices as tumblers, stationary shells or troughs, Muller mixers, which are either batch type or continuous type, impact mixers, and the like.

It can be desirable to form an agglomerate of the mixture of zeolite component and binder to be treated with steam, or steam and acid. Any suitable means known by those skilled in the art for forming such an agglomerate can be used. Such methods include, for example, molding, tableting, pressing, pelletizing, extruding, tumbling, and densifying. Further discussion of such methods is provided in a section entitled "Size Enlargement" in *Perry's Chemical Engineers' Handbook, Sixth Edition,* published by McGraw-Hill, Inc., copyright 1984, at pages 8–60 through 8–72, which pages are incorporated herein by reference.

Generally, the zeolite and binder components are compounded and subsequently shaped (such as by pelletizing, extruding or tableting) into a compounded composition. Generally, the surface area of the compounded composition is in the range of from about 50 $m^2/g$ to about 700 $m^2/g$. Generally, the particle size of the compounded composition is in the range of from about 1 mm to about 10 mm.

Any suitable hydrocarbon-containing fluid which comprises paraffins (alkanes) and/or olefins (alkenes) and/or naphthenes (cycloalkanes), wherein each of these hydrocarbons contains in the range of from about 2 carbon atoms per molecule to about 16 carbon atoms per molecule, can be used as the fluid to be contacted with the improved zeolite catalyst composition under suitable process conditions for obtaining a reaction product comprising lower, also referred to as light, olefins (alkenes, such as ethylene, propylene, and butene), containing in the range of from about 2 carbon atoms per molecule to about 5 carbon atoms per molecule, and aromatic hydrocarbons (such as BTX, i.e., benzene, toluene, and xylene). Frequently, the suitable hydrocarbon-containing fluid also contains aromatic hydrocarbons. The term "fluid" is used herein to denote gas, liquid, vapor, or combinations thereof.

Non-limiting examples of suitable, available hydrocarbon-containing fluid include gasolines from catalytic oil cracking (e.g., FCC and hydrocracking) processes, pyrolysis gasolines from thermal hydrocarbon- (e.g., ethane, propane, and naphtha) cracking processes, naphthas, gas oils, reformates, straight-run gasoline and combinations thereof. Though the particular composition of the fluid is not critical, the preferred hydrocarbon-containing fluid is a gasoline-boiling range hydrocarbon-containing fluid suitable for use as at least a gasoline blend stock generally having a boiling range of about 30° C. to about 210° C. Generally, the content of paraffins exceeds the combined content of olefins, naphthenes and aromatics (if present).

The hydrocarbon-containing fluid can be contacted by any suitable means, method(s), or manner with the improved zeolite catalyst composition, described herein, contained within a conversion zone. The contacting step can be operated as a batch process step or, preferably, as a continuous process step. In the latter operation, a solid catalyst bed, or a moving catalyst bed, or a fluidized catalyst bed can be employed. Any of these operational modes have advantages and disadvantages, and those skilled in the art can select the one most suitable for a particular fluid and catalyst.

The contacting step is preferably carried out within a conversion zone, wherein is contained the improved zeolite catalyst composition, and under reaction conditions, i.e., conversion conditions, that suitably promote the formation of olefins, preferably light olefins, and aromatics, preferably BTX, from at least a portion of the hydrocarbons of the hydrocarbon-containing fluid. Thus, the reaction product, i.e., the conversion product, includes olefins and aromatics.

Reaction, or conversion, conditions would include a reaction temperature of the contacting step preferably in the range of from about 400° C. to about 800° C., more preferably in the range of from about 450° C. to about 750° C., and most preferably in the range from 500° C. to 700° C. The contacting pressure can be in the range of from below atmospheric pressure upwardly to about 500 pounds per square inch absolute (psia), preferably, from about atmospheric to about 450 psia and, most preferably, from 20 psia to 400 psia.

The flow rate at which the hydrocarbon-containing fluid is charged (i.e., the charge rate of hydrocarbon-containing fluid) to the conversion zone is such as to provide a weight hourly space velocity ("WHSV") in the range of from exceeding 0 $hour^{-1}$ upwardly to about 1000 $hours^{-1}$. The term "weight hourly space velocity", as used herein, shall mean the numerical ratio of the rate at which a hydrocarbon-containing fluid is charged to the conversion zone in pounds per hour divided by the pounds of catalyst contained in the conversion zone to which the hydrocarbon-containing fluid is charged. The preferred WHSV of the hydrocarbon-containing fluid to the conversion zone can be in the range of from about 0.25 $hour^{-1}$ to about 250 $hour^{-1}$ and most preferably in the range from 0.5 $hour^{-1}$ to 100 $hour^{-1}$.

The process effluent, from the conversion zone generally contains: a light gas fraction comprising hydrogen and methane, a $C_2$–$C_3$ fraction containing ethylene, propylene, ethane, and propane, an intermediate fraction including non-aromatic compounds having greater than 3 carbon atoms, a BTX aromatic hydrocarbons fraction (benzene, toluene, ortho-xylene, meta-xylene, and para-xylene), and a $C_9$+ fraction which contains aromatic compounds having 9 or more carbon atoms per molecule.

Generally, the process effluent can be separated into these principal fractions by any known method(s) such as, for example, fractionation distillation. Because the separation method(s) are well known to one skilled in the art, the description of such separation method(s) is omitted herein. The intermediate fraction can be fed to an aromatization reactor to be converted to aromatic hydrocarbons. The methane, ethane, and propane can be used as fuel gas or as a feed for other reactions such as, for example, in a thermal cracking process to produce ethylene and propylene. The olefins can be recovered and further separated into individual olefins by any method(s) known to one skilled in the art. The individual olefins can then be recovered and marketed. The BTX fraction can be further separated into individual $C_6$ to $C_8$ aromatic hydrocarbon fractions. Alternatively, the BTX fraction can further undergo one or more reactions either before or after separation to individual $C_6$ to $C_8$ hydrocarbons so as to increase the content of the most desired BTX aromatic hydrocarbon. Suitable examples of such subsequent $C_6$ to $C_8$ aromatic hydrocarbon conversions are disproportionation of toluene (to form benzene and xylenes), transalkylation of benzene and xylenes (to form toluene), and isomerization of meta-xylene and/or ortho-xylene to para-xylene.

After the improved zeolite catalyst composition has been deactivated by, for example, coke deposition, to an extent that the hydrocarbon conversion and/or the selectivity to the desired ratios of olefins to aromatics has become unsatisfactory, the improved zeolite catalyst composition can be reactivated by any means or method(s) known to one skilled in the art such as, for example, calcining in air to burn off deposited coke and other carbonaceous materials, such as oligomers or polymers, preferably at a temperature in the range of from about 400° C. to about 1000° C. The optimal time periods of the calcining depend generally on the types and amounts of deactivating deposits on the catalyst composition and on the calcination temperatures. These optimal time periods can easily be determined by those possessing ordinary skill(s) in the art and are omitted herein for the interest of brevity.

The following examples are presented to further illustrate this invention and are not to be construed as unduly limiting the scope of this invention.

EXAMPLE I

This example illustrates the preparation of several catalysts which were subsequently tested as catalysts in the conversion of a gasoline fluid sample to lower olefins (such as, ethylene, propylene, and butene) and aromatics (such as, BTX). The gasoline sample had been produced in a commercial fluidized catalytic cracking unit (FCC).

Catalyst A (Control)

A 5 gram quantity of zinc nitrate hexahydrate ($Zn(NO_3)_2.6H_2O$) was mixed with a 150 mL quantity of deionized water. A 100 gram quantity of commercially available ZSM-5 Zeocat PZ2/50H powder (a zeolite having a $SiO_2$:$Al_2O_3$ mole ratio of 50 provided by Chemie Uetikon AG, Uetikon, Switzerland) was added to the zinc nitrate/deionized water mixture at room temperature (about 20° C. to about 25° C.) and atmospheric pressure (about 14.7 pounds per square inch absolute). The zinc nitrate/deionized water/ZSM-5 (Zn/ZSM-5) mixture was maintained at room temperature and atmospheric pressure for about 16 hours (i.e., overnight). The Zn/ZSM-5 mixture was then dried at 120° C. for about 3 hours. A 3.13 gram quantity of bentonite, a 26.7 gram quantity of chlorhydrol (50% w/w solution, provided by Reheis, Inc.) and a 72 mL quantity of deionized water were then added to the dried Zn/ZSM-5 mixture to form a Zn/ZSM-5/Bentonite mixture. The resulting Zn/ZSM-5/Bentonite mixture was then dried at 120° C. for about 3 hours and then calcined in air for about 3 hours at 520° C. to produce a final product (Control Catalyst A) weighing 110 grams. The final product contained a zinc (Zn) concentration of 1 percent of the total weight of the final product.

Catalyst B (Control)

A 60 gram quantity of commercially available ZSM-5 Zeocat PZ2/50H powder (a zeolite having a $SiO_2$:$Al_2O_3$ mole ratio of 50 provided by Chemie Uetikon AG, Uetikon, Switzerland) was treated in a steam atmosphere for about 16 hours at 500° C. with a $H_2O$ flow rate of 3 mL/hr to produce a steam pre-treated ZSM-5. A 10 gram quantity of this steam pre-treated ZSM-5 Zeocat PZ2/50H powder (steam pre-treated ZSM-5) was then added to a solution containing a 0.5 gram quantity of zinc nitrate hexahydrate ($Zn(NO_3)_2.6H_2O$) and a 15 mL quantity of deionized water at room temperature (about 20° C. to about 25° C.) and atmospheric pressure (about 14.7 pounds per square inch absolute). The resulting steam pre-treated ZSM-5/zinc nitrate (steam pre-treated ZSM-5/Zn) mixture was maintained at room temperature and atmospheric pressure for about 16 hours (i.e., overnight). The steam pre-treated ZSM-5/Zn mixture was then dried at 120° C. for about 3 hours. A mixture containing a 0.31 gram quantity of bentonite, a 2.67 gram quantity of chlorhydrol (50% w/w solution, provided by Reheis, Inc.) and a 7 mL quantity of deionized water was then added to the dried, steam pre-treated ZSM-5/Zn mixture. The resulting steam pre-treated ZSM-5/Zn/Bentonite mixture was then dried at 120° C. for about 3 hours and then calcined in air for about 3 hours at 520° C. to produce a final product (Control Catalyst B) weighing 11 grams. The final product contained a zinc (Zn) concentration of 1 percent of the total weight of the final product.

Catalyst C (Control)

A 60 gram quantity of commercially available ZSM-5 Zeocat PZ2/50H powder (a zeolite having a $SiO_2$:$Al_2O_3$ mole ratio of 50 provided by Chemie Uetikon AG, Uetikon, Switzerland) was treated in a steam atmosphere for about 16 hours at 500° C. with a $H_2O$ flow rate of 3 mL/hr to produce a steam pre-treated ZSM-5. A 10 gram quantity of this steam pre-treated ZSM-5 Zeocat PZ2/50H powder (i.e., steam pre-treated ZSM-5) was then added to 100 mL of 0.2 molar hydrochloric acid solution at room temperature (about 20° C. to about 25 ° C.) and atmospheric pressure (about 14.7 pounds per square inch absolute). The resulting mixture was stirred for about 5 minutes. The hydrochloric acid solution was decanted. A new 100 mL quantity of 0.2 molar hydrochloric acid solution was added to the steam pre-treated ZSM-5 at room temperature and atmospheric pressure. The resulting mixture was stirred for about 5 minutes. The hydrochloric acid solution was decanted. Another new 100 mL quantity of 0.2 molar hydrochloric acid solution was added to the steam pre-treated ZSM-5 at room temperature and atmospheric pressure. The steam pre-treated ZSM-5/hydrochloric acid solution was heated to about 65° C. for about 5 minutes. The solution was filtered and the catalyst composition was washed with an approximately 200 mL quantity of deionized water. The resulting steam pre-treated, acid pre-treated ZSM-5 material was dried at 120° C. for about 3 hours and weighed 9.5 grams. This material was then added to a solution containing a 0.48 gram quantity of zinc nitrate hexahydrate ($Zn(NO_3)_2.6H_2O$) and a 15 mL quantity of deionized water at room temperature and atmospheric pressure. The resulting steam pre-treated, acid pre-treated ZSM-5/zinc nitrate (steam pre-treated, acid pre-treated ZSM-5/Zn) mixture was maintained at room temperature and atmospheric pressure for about 16 hours (i.e., overnight). The steam pre-treated, acid pre-treated ZSM-5/Zn mixture was then dried at 120° C. for about 3 hours. A mixture containing a 0.30 gram quantity of bentonite, a 2.53 gram quantity of chlorhydrol (50% w/w solution, provided by Reheis, Inc.) and a 7 mL quantity of deionized water was then added to the dried, steam pre-treated, acid pre-treated ZSM-5/Zn mixture. The resulting steam pre-treated, acid pre-treated ZSM-5/Zn/Bentonite mixture was then dried at 120° C. for about 3 hours and then calcined in air for about 3 hours at 520° C. to produce a final product (Control Catalyst C) weighing 10.5 grams. The final product contained a zinc (Zn) concentration of 1 percent of the total weight of the final product.

Catalyst D (Invention)

A 20 gram quantity of Control Catalyst A (described above as a dried and calcined Zn/ZSM-5/Bentonite mixture of which the ZSM-5 had not been pre-treated with steam or acid prior to incorporation of the ZSM-5 with the zinc component) was treated (i.e., the Zn/ZSM-5 catalyst was post-treated) in a steam atmosphere for about 16 hours at 500° C. with a $H_2O$ flow rate of 3 mL/hr to produce a 20 gram quantity of final product (Invention Catalyst D). The final product contained a zinc (Zn) concentration of 1 percent of the total weight of the final product.

Catalyst E (Invention)

A 3.85 gram quantity of Invention Catalyst D (described above as a Zn/ZSM-5 catalyst post-treated with steam of which the ZSM-5 had not been pre-treated with steam or acid prior to incorporation of the ZSM-5 with the zinc component) was added to 40 mL of 0.2 molar hydrochloric acid solution at room temperature (about 20° C. to about 25° C.) and atmospheric pressure (about 14.7 pounds per square inch absolute). The resulting mixture was stirred for about 5 minutes. The hydrochloric acid solution was decanted. A new 40 mL quantity of 0.2 molar hydrochloric acid solution was then added to the quantity of catalyst composition at room temperature and atmospheric pressure. The resulting mixture was stirred for about 5 minutes. The hydrochloric acid solution was decanted. Another new 40 mL quantity of 0.2 molar hydrochloric acid solution was then added to the quantity of catalyst composition at room temperature and atmospheric pressure. The catalyst composition/hydrochloric acid solution was heated to about 65 ° C. for about 5 minutes. The solution was filtered and the catalyst composition was washed with an approximately 100 mL quantity of deionized water. The resulting steam-treated, acid-treated catalyst composition (i.e., Zn/ZSM-5 catalyst post-treated with steam and acid) was then dried at 120° C. for about 3 hours and then calcined in air for about 3 hours at 520° C. to produce a final product (Invention Catalyst E) weighing 3.54 grams.

EXAMPLE II

This example illustrates the use of the catalysts described in Example I as catalysts in the conversion of a catalytically-cracked gasoline boiling range fluid to aromatic hydrocarbons (such as benzene, toluene and xylenes, i.e., BTX) and lower olefins (such as ethylene, propylene, and butene).

For each of the test runs, a 3 gram sample of the catalyst materials described in Example I, sized to 10–20 mesh, was placed into a stainless steel tube reactor (length: about 18 inches; inner diameter: about 0.5 inch). Gasoline boiling range fluid from a catalytic cracking unit of a refinery was passed through the reactor at a flow rate of 20 mL/hour such as to provide a weight hourly space velocity ("WHSV") of 4.86 $hr^{-1}$, at a temperature of about 550° C. and at atmospheric pressure (about 0 pounds per square inch gauge). The formed reaction product exited the reactor tube and passed through several ice-cooled traps. The liquid portion remained in these traps and was weighed, whereas the volume of the gaseous portion which exited the traps was measured in a "wet test meter". Liquid and gaseous product samples (collected at hourly intervals) were analyzed by means of a gas chromatograph. Results of five test runs for Catalysts A through E are summarized in Table I. All test data were obtained after 6 hours on stream.

TABLE I

| Catalyst | Catalyst Preparation | BTX Yield (wt-%) | Light Olefin[a] Yield (wt-%) | Sum of BTX and Olefin | Olefin/BTX Ratio | Avg wt-% Coke/hr[b] |
|---|---|---|---|---|---|---|
| A (Control) | (NO STM/NO AT)[c] | 50.9 | 11.1 | 62.0 | 0.22 | 1.33 |
| B (Control) | (PRE-STM)[d] | 44.4 | 15.4 | 59.8 | 0.35 | 1.13 |
| C (Control) | (PRE-STM/AT)[e] | 44.8 | 15.4 | 60.2 | 0.34 | 1.28 |
| D (Invention) | (POST-STM)[f] | 38.1 | 18.7 | 56.8 | 0.49 | 0.65 |
| E (Invention) | (POST-STM/AT)[g] | 39.5 | 17.7 | 57.2 | 0.45 | 0.58 |

[a]Ethylene, Propylene, and Butene
[b]Coke was determined at the end of the reaction by removing the catalysts from the reactor and measuring the coke with a thermal gravimetric analyzer (TGA), manufactured by TA Instruments, New Castle, Delaware.
[c]Neither the ZSM-5 (of the Zn/ZSM-5 catalyst) nor the Zn/ZSM-5 catalyst were pre-treated or post-treated with steam or acid.
[d]ZSM-5 (of the Zn/ZSM-5 catalyst) was pre-treated with steam.
[e]ZSM-5 (of the Zn/ZSM-5 catalyst) was pre-treated with steam and then pre-treated with acid.
[f]Zn/ZSM-5 catalyst was post-treated with steam.
[g]Zn/ZSM-5 catalyst was post-treated with steam and then post-treated with acid.

The test data in Table I clearly show that Invention Catalysts D and E exhibited considerably less coking than Control Catalysts A, B, and C. The test data also demonstrates that Invention Catalysts D and E yielded significantly more light olefins and an improved (i.e., greater) Olefin/BTX ratio when compared to Control Catalysts A, B, and C. The performance of Invention Catalysts D and E, as compared to Control Catalysts A, B, and C, is superior when comparing the light olefin yield and Olefin/BTX ratio. The improvement in the performance of the invention catalysts is believed to be due to the novel process of making the inventive catalyst composition. The improvement in catalyst performance is also significant given the fact that Invention Catalysts D and E use a zeolite that has not been pre-treated with steam or acid.

The difference in performance between the invention catalysts and the control catalysts is certainly unexpected. One would not expect that post-treatment of a Zn/ZSM-5 catalyst with steam, or steam and acid, in lieu of a pre-treatment of the ZSM-5, would enhance the performance of the final Zn/ZSM-5 catalyst. The results demonstrate that Invention Catalysts D and E, in which the Zn/ZSM-5 catalyst has been post-treated with steam, or steam and acid, as opposed to Control Catalysts A, B, and C, in which the ZSM-5 has either been pre-treated with steam, or steam and acid, or not pre-treated at all, gives a catalyst that is significantly superior to the control catalysts.

EXAMPLE III

This example illustrates that the stability (in terms of BTX yield over time and lower olefin yield over time) of Invention Catalysts D and E described in Example I is superior to Control Catalysts A, B, and C when such catalysts are used in the conversion of a catalytically-cracked gasoline boiling range fluid to aromatic hydrocarbons (such as benzene, toluene and xylenes, i.e., BTX) and lower olefins (such as ethylene, propylene, and butene).

Figure 2:
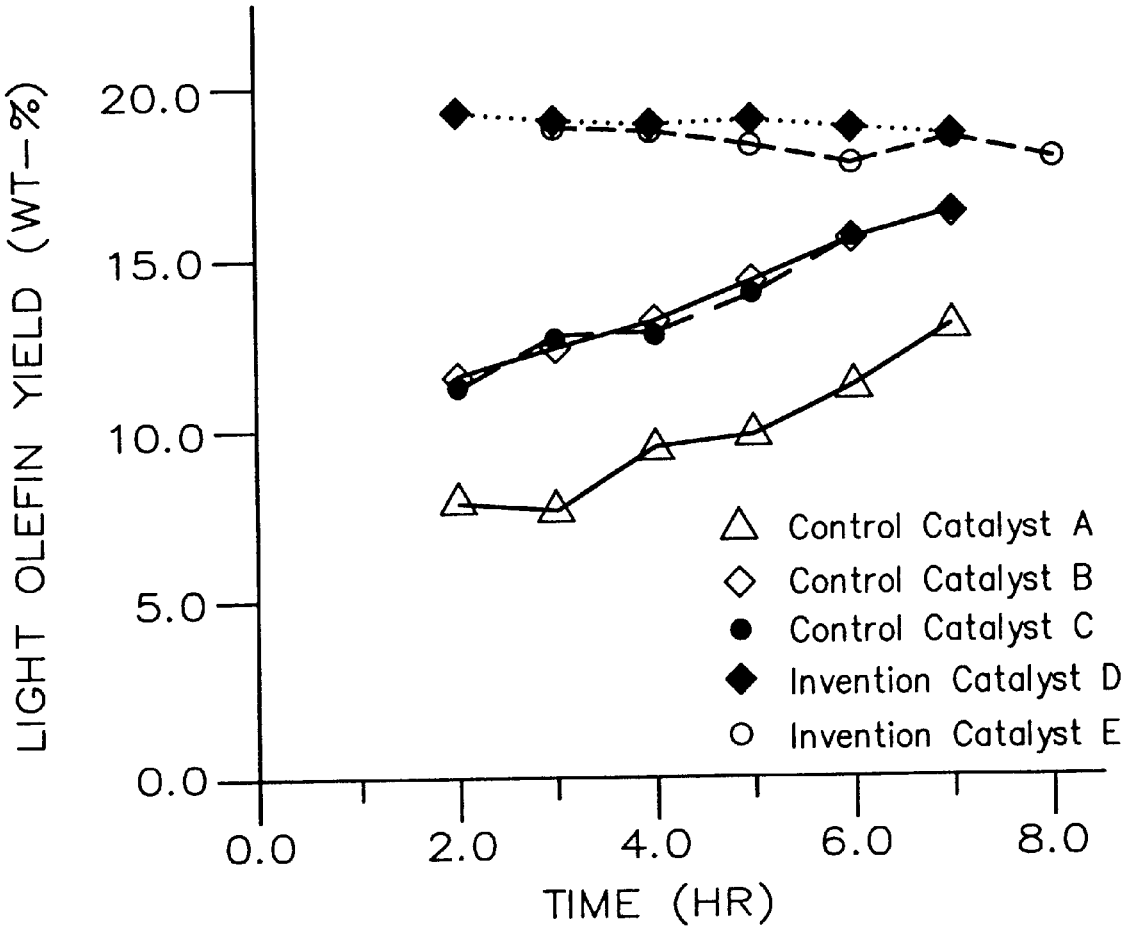
FIG. 2 is a plot of the light olefin yield versus time for the inventive catalysts and the control catalysts illustrating that the productivity (in terms of light olefin wt-% yield) and stability (in terms of light olefin wt-% yield over time) of the inventive catalysts are greater than the control catalysts.

Further data obtained from the trial runs conducted in Example II, described above, are summarized in Tables II and III below. The test data in Tables II and III illustrates an on-stream 7-hour time period in 1-hour segments. Data was obtained starting with the second hour for all runs except Run V (Run V was conducted for 8 hours with data being obtained starting with the third hour). The data in Table II is plotted in FIG. 1 and the data in Table III is plotted in FIG. 2.

TABLE II

| | BTX Yield (wt-%) | | | | |
|---|---|---|---|---|---|
| Time[a] | Run I[b] | Run II[c] | Run III[d] | Run IV[e] | Run V[f] |
| 2 | 58.6 | 54.7 | 56.1 | 40.7 | — |
| 3 | 58.2 | 50.6 | 50.6 | 40.1 | 40.4 |
| 4 | 55.0 | 50.0 | 49.1 | 39.2 | 39.9 |
| 5 | 53.1 | 45.5 | 47.5 | 38.3 | 39.9 |
| 6 | 50.9 | 44.4 | 44.8 | 38.1 | 39.5 |
| 7 | 48.3 | 42.7 | 42.8 | 37.2 | 39.6 |
| 8 | — | — | — | — | 39.0 |

[a]One-hour segments over a seven-hour on-stream time period. Data was obtained beginning at the two-hour mark for all runs except Run V.
[b]Control Catalyst A (neither the ZSM-5 (of the Zn/ZSM-5 catalyst) nor the Zn/ZSM-5 catalyst were pre-treated or post-treated with steam or acid).
[c]Control Catalyst B (ZSM-5, of the Zn/ZSM-5 catalyst, was pre-treated with steam).
[d]Control Catalyst C (ZSM-5, of the Zn/ZSM-5 catalyst, was pre-treated with steam and then pre-treated with acid).
[e]Invention Catalyst D (Zn/ZSM-5 catalyst was post-treated with steam).
[f]Invention Catalyst E (Zn/ZSM-5 catalyst was post-treated with steam and then post-treated with acid).

TABLE III

| | Light Olefin (ethylene, propylene, and butene) Yield (wt-%) | | | | |
|---|---|---|---|---|---|
| Time[a] | Run I[b] | Run II[c] | Run III[d] | Run IV[e] | Run V[f] |
| 2 | 7.8 | 11.4 | 11.1 | 19.1 | — |
| 3 | 7.6 | 12.2 | 12.5 | 18.9 | 18.8 |
| 4 | 9.4 | 13.0 | 12.7 | 18.8 | 18.6 |
| 5 | 9.8 | 14.1 | 13.8 | 18.9 | 18.2 |
| 6 | 11.1 | 15.4 | 15.4 | 18.7 | 17.7 |
| 7 | 12.9 | 16.0 | 16.0 | 18.4 | 18.3 |
| 8 | — | — | — | — | 17.9 |

[a]One-hour segments over a seven-hour on-stream time period. Data was obtained beginning at the two-hour mark for all runs except Run V.

TABLE III-continued

| Light Olefin (ethylene, propylene, and butene) Yield (wt-%) | | | | | |
|---|---|---|---|---|---|
| Time[a] | Run I[b] | Run II[c] | Run III[d] | Run IV[e] | Run V[f] |

[b]Control Catalyst A (neither the ZSM-5 (of the Zn/ZSM-5 catalyst) nor the Zn/ZSM-5 catalyst were pre-treated or post-treated with steam or acid).
[c]Control Catalyst B (ZSM-5, of the Zn/ZSM-5 catalyst, was pre-treated with steam).
[d]Control Catalyst C (ZSM-5, of the Zn/ZSM-5 catalyst, was pre-treated with steam and then pre-treated with acid).
[e]Invention Catalyst D (Zn/ZSM-5 catalyst was post-treated with steam).
[f]Invention Catalyst E (Zn/ZSM-5 catalyst was post-treated with steam and then post-treated with acid).

The data in Table II (such data is plotted in FIG. 1) and Table III (such data is plotted in FIG. 2) demonstrates that the invention catalysts exhibited greater stability, in terms of BTX yield over time and light olefin yield over time, when compared to the control catalysts. Control Catalysts A, B, and C (see FIG. 1, also Runs I, II, and III respectively in Table II) each exhibited a significant decrease in BTX yield over the seven-hour on-stream period whereas the BTX yield of Invention Catalysts D and E (see FIG. 1, also Runs IV and V respectively in Table II) remained almost constant. Similarly, Control Catalysts A, B, and C (see FIG. 2, also Runs I, II, and III respectively in Table III) each exhibited a significant increase in light olefin yield over the seven-hour on-stream period whereas the light olefin yield of Invention Catalysts D and E (see FIG. 2, also Runs IV and V respectively in Table III) remained almost constant. The improvement in catalyst stability is significant given the fact that Invention Catalysts D and E use a zeolite that has not been pre-treated with steam or acid.

The difference in stability between the invention catalysts and the control catalysts is certainly unexpected. One would not expect that post-treatment of a Zn/ZSM-5 catalyst with steam, or steam and acid, in lieu of a pre-treatment of the ZSM-5, would enhance the stability of the final Zn/ZSM-5 catalyst. The results demonstrate that Invention Catalysts D and E in which the Zn/ZSM-5 has been post-treated with steam, or steam and acid, as opposed to pre-treatment of the ZSM-5 with steam, or steam and acid, or not pre-treated at all, gives a catalyst that is significantly more stable than the control catalysts.

The results shown in the above examples clearly demonstrate that the present invention is well adapted to carry out the objects and attain the ends and advantages mentioned as well as those inherent therein.

Reasonable variations, modifications, and adaptations can be made within the scope of the disclosure and the appended claims without departing from the scope of this invention.

What is claimed is:

1. A process comprising contacting, under reaction conditions, a hydrocarbon-containing fluid with a catalyst, wherein a reaction product includes olefins and aromatics, and further wherein said catalyst is prepared by a process consisting essentially of:

(a) incorporating a zinc component with a ZSM-5 to form an incorporated ZSM-5, and (b) steam treating said incorporated ZSM-5 to form an incorporated, steam-treated ZSM-5.

2. A process according to claim 1, wherein the amount of said zinc component incorporated with said ZSM-5 provides a concentration of zinc in said catalyst in the range of from about 0.05 weight percent to about 8 weight percent of the total weight of said catalyst.

3. A process according to claim 1, wherein said incorporating step (a) consists essentially of impregnating said ZSM-5 with an impregnating solution containing said zinc component.

4. A process according to claim 3, wherein said zinc component is selected from the group consisting of zinc nitrate, hydrated zinc nitrate, diethylzinc, dimethylzinc, diphenylzinc, zinc acetate dehydrate, zinc acetylacetonate hydrate, zinc bromide, zinc carbonate hydroxide, zinc chloride, zinc cyclohexanebutyrate dihydrate, zinc 2-ethylhexanoate, zinc fluoride, zinc fluoride tetrahydrate, zinc hexafluoroacetylacetonate dihydrate, zinc iodide, zinc molybdate, zinc naphthenate, zinc nitrate hexahydrate, zinc oxide, zinc perchlorate hexahydrate, zinc phosphate hydrate, zinc phthalocynine, zinc protoporphyrin, zinc selenide, zinc sulfate monohydrate, zinc sulfide, zinc telluride, zinc tetrafluoroborate hydrate, zinc meso-tetraphenylprophine, zinc titanate, zinc trifluoromethanesulfonate, and combinations thereof.

5. A process according to claim 4, wherein said zinc component is zinc nitrate.

6. A process according to claim 1, wherein said steam treating step (b) consists essentially of exposing said incorporated ZSM-5 to a steam atmosphere having a concentration of steam exceeding about 90 molar percent, a pressure in the range of about atmospheric to about 1000 pounds per square inch absolute, a temperature in the range of from about 100° C. to about 1000° C., and a time period in the range of from about 0.1 hour to about 30 hours.

7. A process according to claim 1, wherein said catalyst has a coking rate that is less than the coking rate of an untreated, or steam pre-treated, or steam and acid pre-treated ZSM-5 which is subsequently incorporated with a zinc component when contacting said hydrocarbon-containing fluid under reaction conditions.

8. A process according to claim 1, wherein said incorporating step (a) further consists essentially of drying said incorporated ZSM-5.

9. A process according to claim 1, wherein said fluid is selected from the group consisting of gasolines from catalytic oil cracking processes, pyrolysis gasolines from thermal hydrocarbon-cracking processes, naphthas, gas oils, reformates, straight-run gasoline and combinations thereof.

10. A process according to claim 1, wherein a hydrocarbon of said hydrocarbon-containing fluid contains in the range of from about 2 carbon atoms per molecule to about 16 carbon atoms per molecule.

11. A process according to claim 1, wherein said reaction conditions comprise a temperature in the range of from about 400° C. to about 800° C., a pressure in the range of about atmospheric pressure to about 500 pounds per square inch absolute, and a charge rate of said hydrocarbon-containing fluid such that the weight hourly space velocity is in the range of from exceeding 0 $hour^{-1}$ upwardly to about 1000 $hour^{-1}$.

12. A process comprising contacting, under reaction conditions, a hydrocarbon-containing fluid with a catalyst, wherein a reaction product includes olefins and aromatics, and further wherein said catalyst is prepared by a process comprising:

(a) incorporating a zinc component with a ZSM-5 to form an incorporated ZSM-5, (b) steam treating said incorporated ZSM-5 to form an incorporated, steam-treated ZSM-5, and (c) acid treating said incorporated, steam-treated ZSM-5 to form an incorporated, steam-treated, acid-treated ZSM-5.

13. A process according to claim 12, wherein said acid-treating step (c) comprises contacting said incorporated, steam-treated ZSM-5 with an acid to form a mixture of acid and said incorporated, steam-treated ZSM-5.

14. A process according to claim 13, wherein said acid-treating step (c) further comprises separating said acid from said incorporated, steam-treated ZSM-5 of said mixture.

15. A process according to claim 13, wherein said mixture can be subjected to a temperature in the range of from about 10° C. to about 80° C. at a pressure in the range of from about atmospheric to about 150 pounds per square inch absolute for a time period in the range of from about 0.1 minute to about 1 hour.

16. A process according to claim 13, wherein said acid is selected from the group consisting of sulfuric acid, hydrochloric acid, nitric acid, phosphoric acid, formic acid, acetic acid, trifluoroacetic acid, trichloroacetic acid, p-toluenesulfonic acid, methanesulfonic acid, partially neutralized acids and combinations thereof.

17. A process according to claim 13, wherein said acid is hydrochloric acid.

18. A process according to claim 13, wherein the concentration of said acid is in the range of from about 0.01 molar to about 15 molar.

19. A process according to claim 12, wherein said acid treating step (c) further comprises drying and calcining said incorporated, steam-treated, acid-treated ZSM-5.

20. A process according to claim 12, wherein the amount of said zinc component incorporated with said ZSM-5 provides a concentration of zinc in said catalyst in the range of from about 0.05 weight percent to about 8 weight percent of the total weight of said catalyst.

21. A process according to claim 12, wherein said incorporating step (a) comprises impregnating said ZSM-5 with an impregnating solution containing said zinc component.

22. A process according to claim 21, wherein said zinc component is selected from the group consisting of zinc nitrate, hydrated zinc nitrate, diethylzinc, dimethylzinc, diphenylzinc, zinc acetate dehydrate, zinc acetylacetonate hydrate, zinc bromide, zinc carbonate hydroxide, zinc chloride, zinc cyclohexanebutyrate dihydrate, zinc 2-ethylhexanoate, zinc fluoride, zinc fluoride tetrahydrate, zinc hexafluoroacetylacetonate dihydrate, zinc iodide, zinc molybdate, zinc naphthenate, zinc nitrate hexahydrate, zinc oxide, zinc perchlorate hexahydrate, zinc phosphate hydrate, zinc phthalocynine, zinc protoporphyrin, zinc selenide, zinc sulfate monohydrate, zinc sulfide, zinc telluride, zinc tetrafluoroborate hydrate, zinc meso-tetraphenylprophine, zinc titanate, zinc trifluoromethanesulfonate, and combinations thereof.

23. A process according to claim 22, wherein said zinc component is zinc nitrate.

24. A process according to claim 12, wherein said steam treating step (b) comprises exposing said incorporated ZSM-5 to a steam atmosphere having a concentration of steam exceeding about 90 molar percent, a pressure in the range of about atmospheric to about 1000 pounds per square inch absolute, a temperature in the range of from about 100° C. to about 1000° C., and a time period in the range of from about 0.1 hour to about 30 hours.

25. A process according to claim 12, wherein said fluid is selected from the group consisting of gasolines from catalytic oil cracking processes, pyrolysis gasolines from thermal hydrocarbon-cracking processes, naphthas, gas oils, reformates, straight-run gasoline and combinations thereof.

26. A process according to claim 12, wherein a hydrocarbon of said hydrocarbon-containing fluid contains in the range of from about 2 carbon atoms per molecule to about 16 carbon atoms per molecule.

27. A process according to claim 12, wherein said reaction conditions comprise a temperature in the range of from about 400° C. to about 800° C., a pressure in the range of about atmospheric pressure to about 500 pounds per square inch absolute, and a charge rate of said hydrocarbon-containing fluid such that the weight hourly space velocity is in the range of from exceeding 0 $hour^{-1}$ upwardly to about 1000 $hour^{-1}$.

* * * * *